US005878845A

United States Patent [19]

Wang

[11] Patent Number: 5,878,845

[45] Date of Patent: Mar. 9, 1999

[54] AUXILIARY EMERGENCY ESCAPE DEVICE OF ELEVATOR

[76] Inventor: chiou nan Wang, No. 50, Alley 97, Lane 354, Sanher Road, Fengyuan City, Taichung County, Taiwan

[21] Appl. No.: 895,753

[22] Filed: Jul. 17, 1997

[51] Int. Cl.[6] ..... B66B 9/04

[52] U.S. Cl. ..... 187/272; 187/263

[58] Field of Search ..... 187/272, 275, 187/263, 253, 266

[56] References Cited

U.S. PATENT DOCUMENTS 4,592,450 6/1986 Schaffer ..... 187/263

*Primary Examiner*—Kenneth Noland

*Attorney, Agent, or Firm*—Pro-Techtor International Services

[57] ABSTRACT

An elevator is provided with an auxiliary escape device consisting of a manually-operated compression-decompression apparatus located at an emergency window of the elevator cab. The compression-decompression apparatus has a fluid pipe and a compression or decompression valve which is fastened at one end thereof with an oil pressure mechanism. In the event of an accident or power outage causing the elevator to incapacitate, the compression-decompression apparatus is exerted on by the pressure of a person's hand so as to actuate the compression or decompression valve, thereby causing the oil pressure cylinder to move up or down to drive the elevator cab upwards or downwards to a desired floor where the trapped passengers can escape.

8 Claims, 10 Drawing Sheets

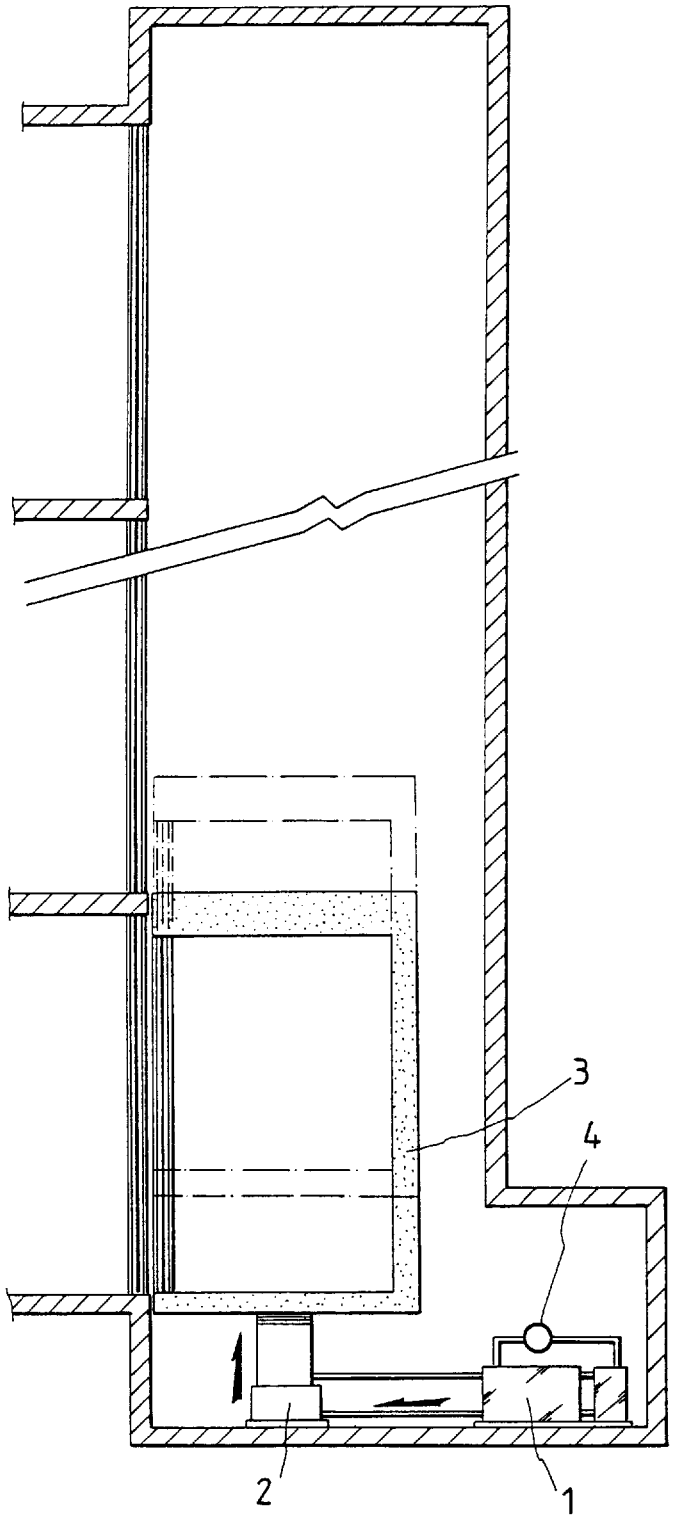
PRIOR ART
FIG, 1

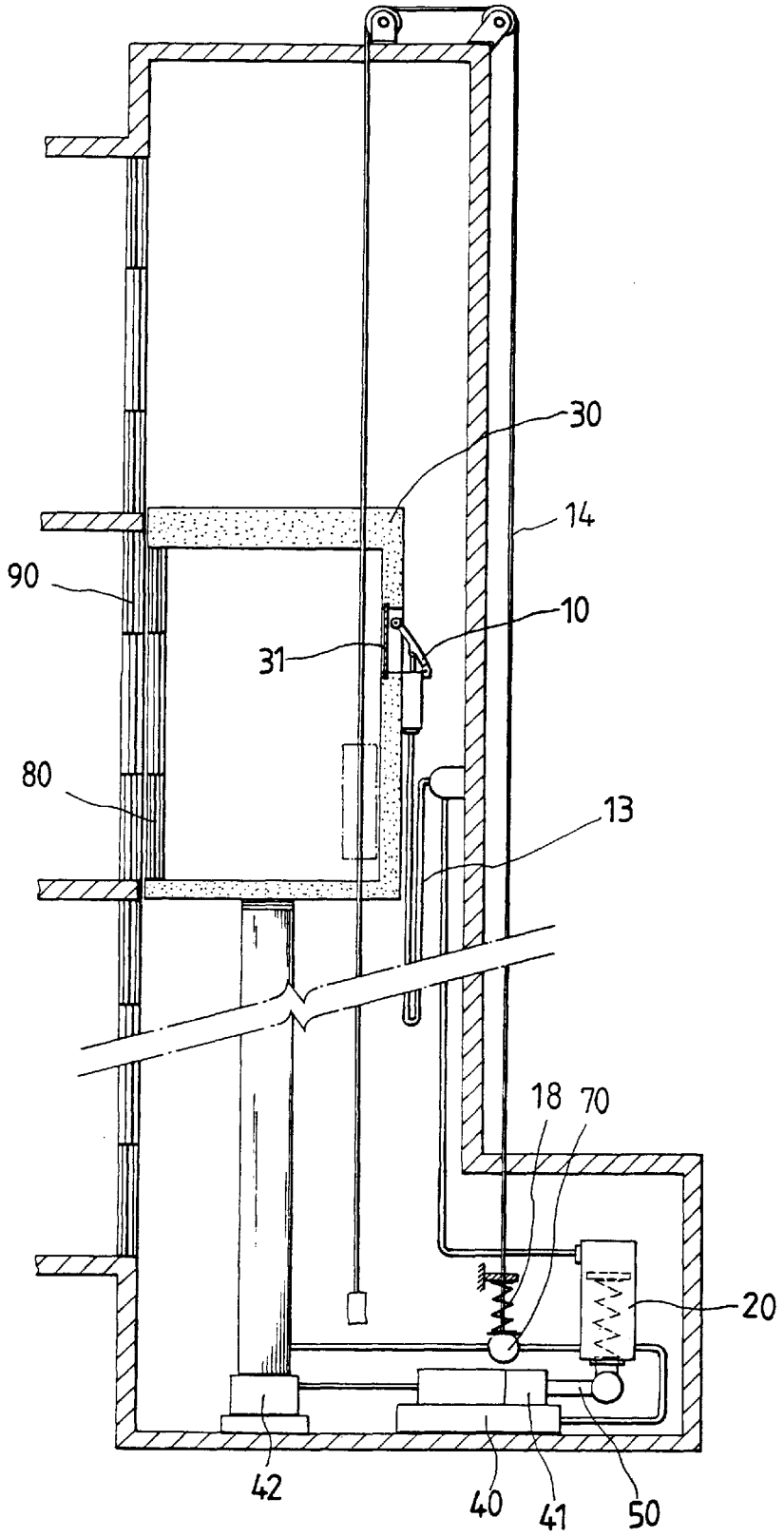
FIG, 2

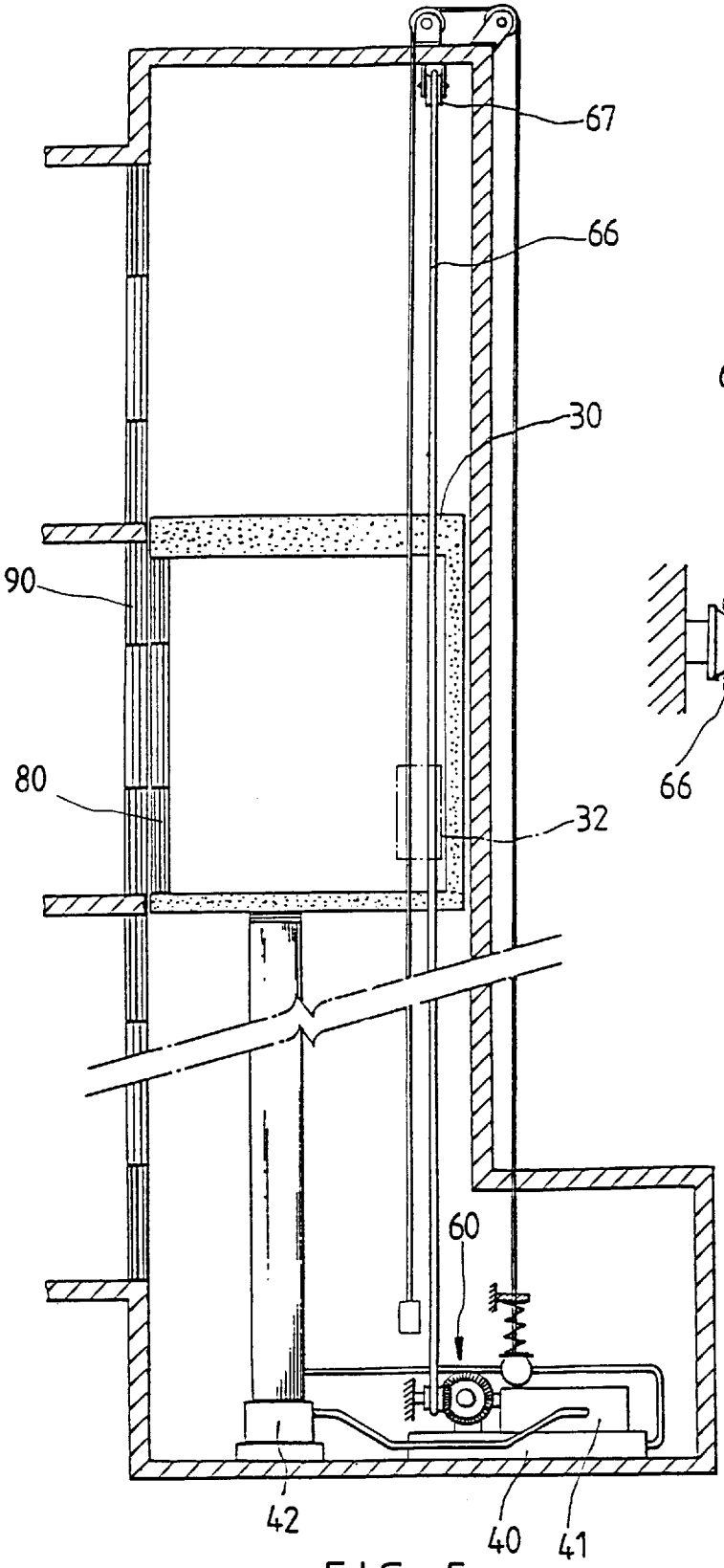
FIG, 5
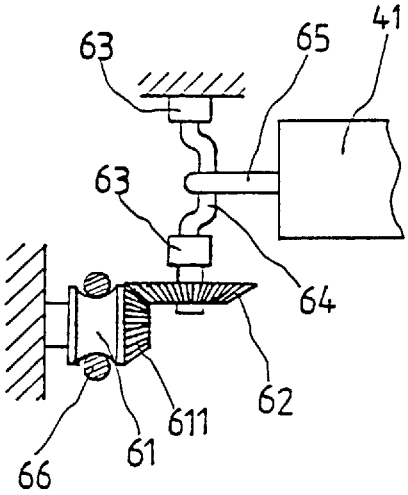
FIG, 6

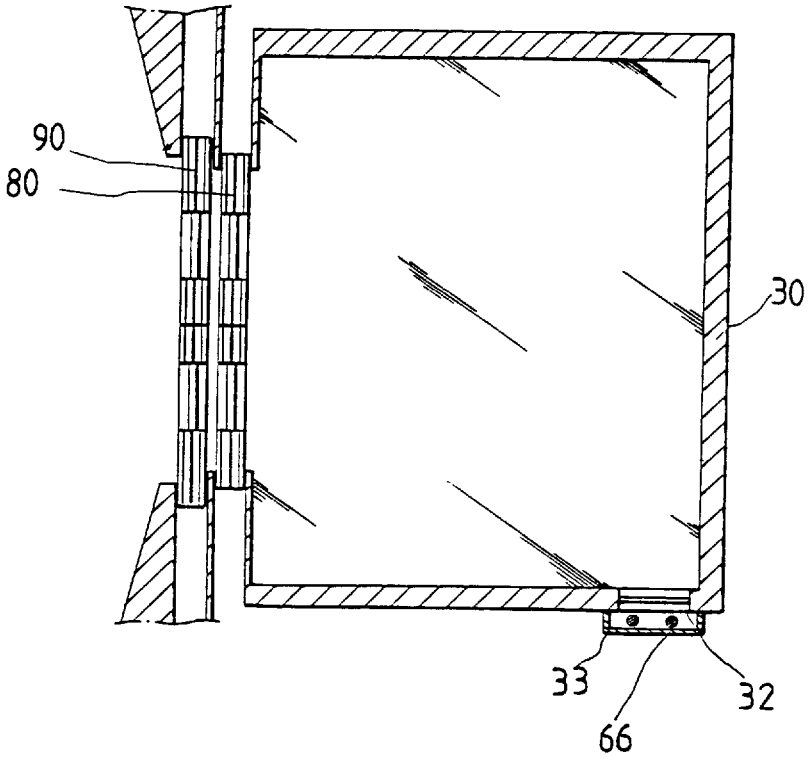
FIG, 7

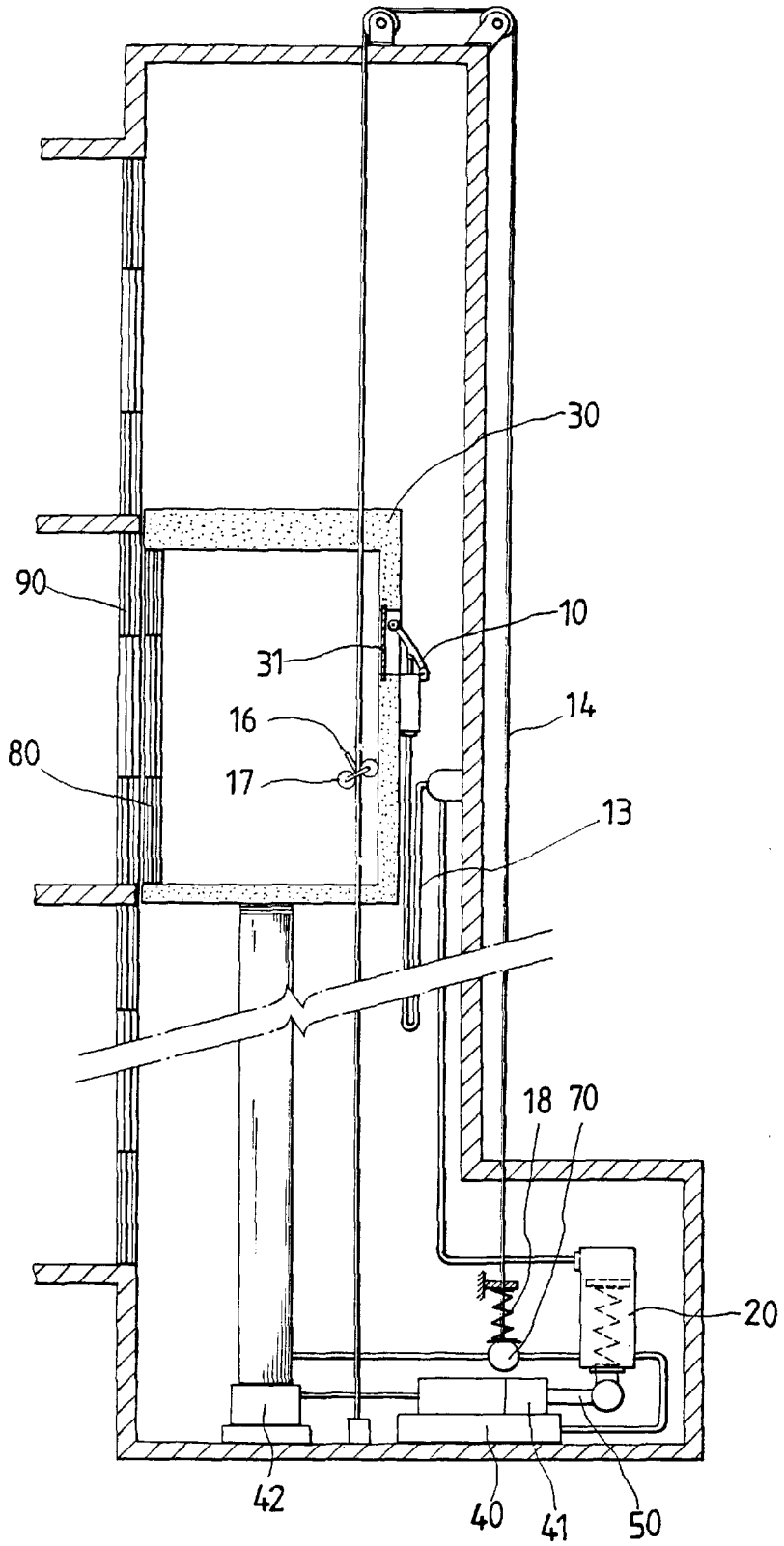
FIG, 8

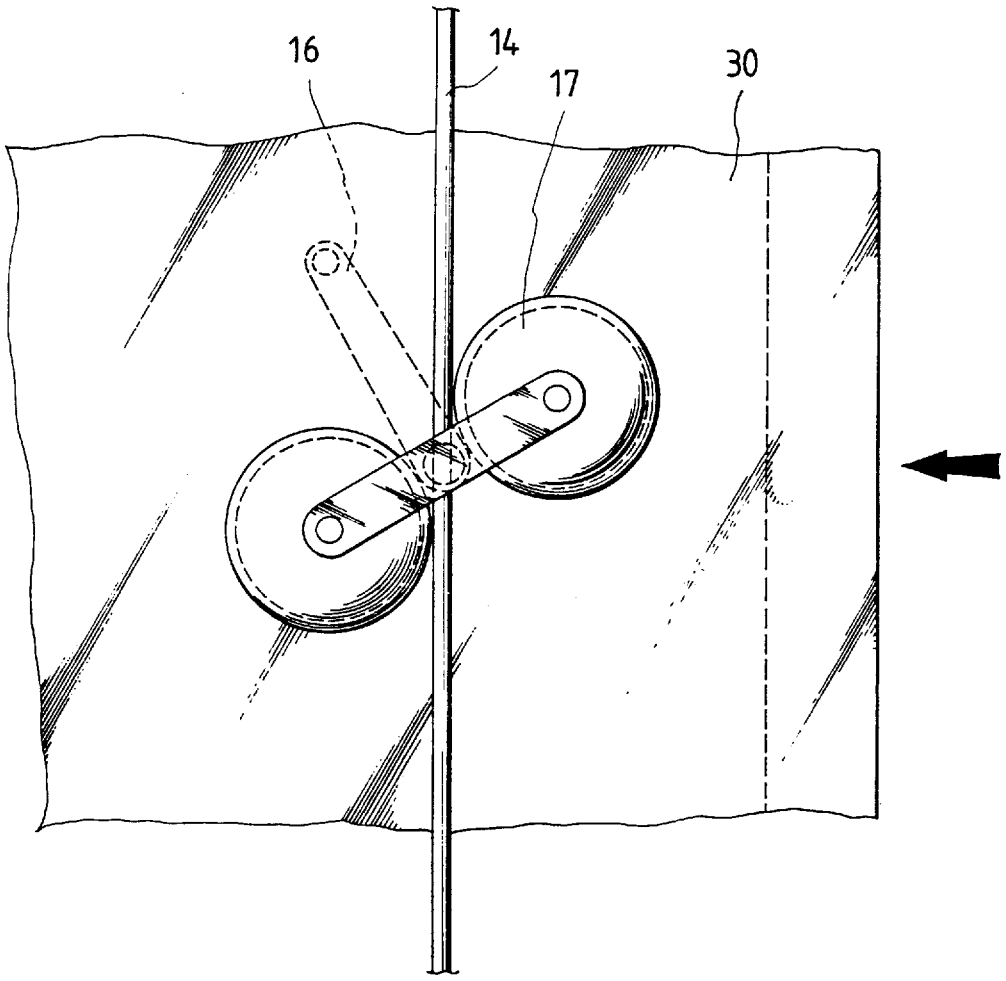
FIG, 9

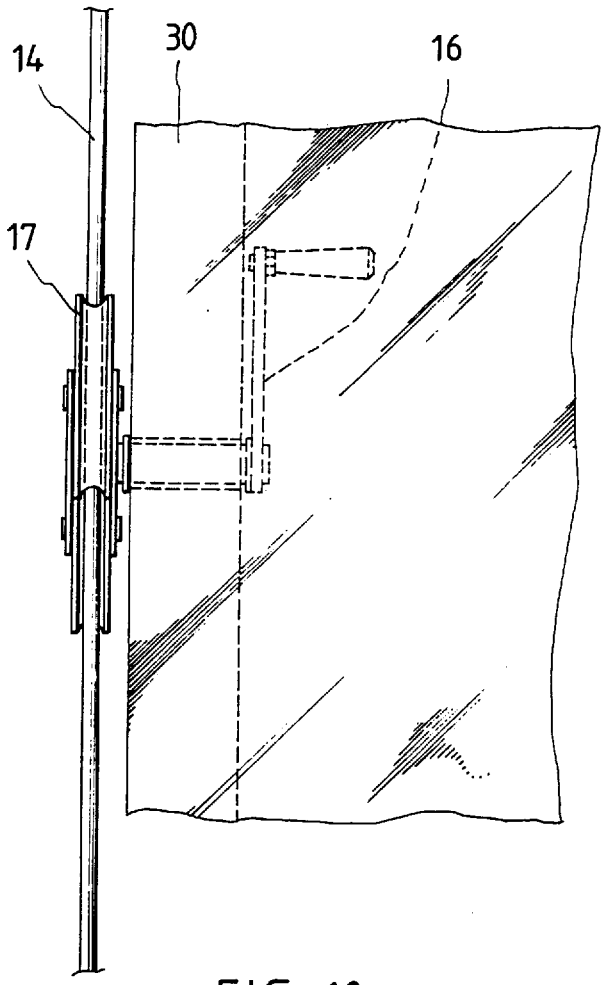
FIG, 10

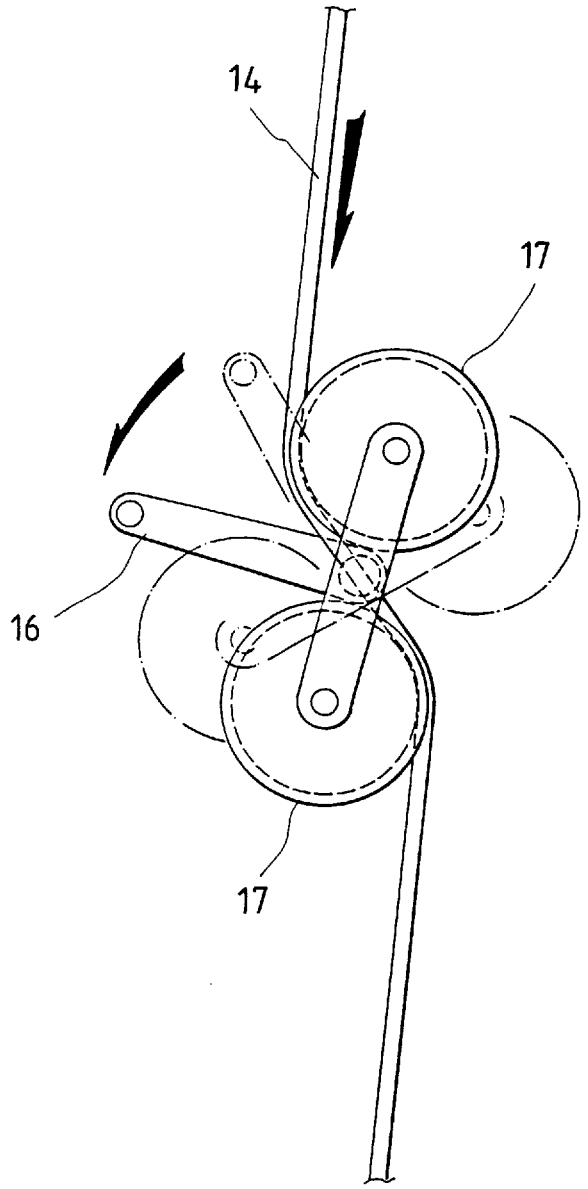
FIG, 11

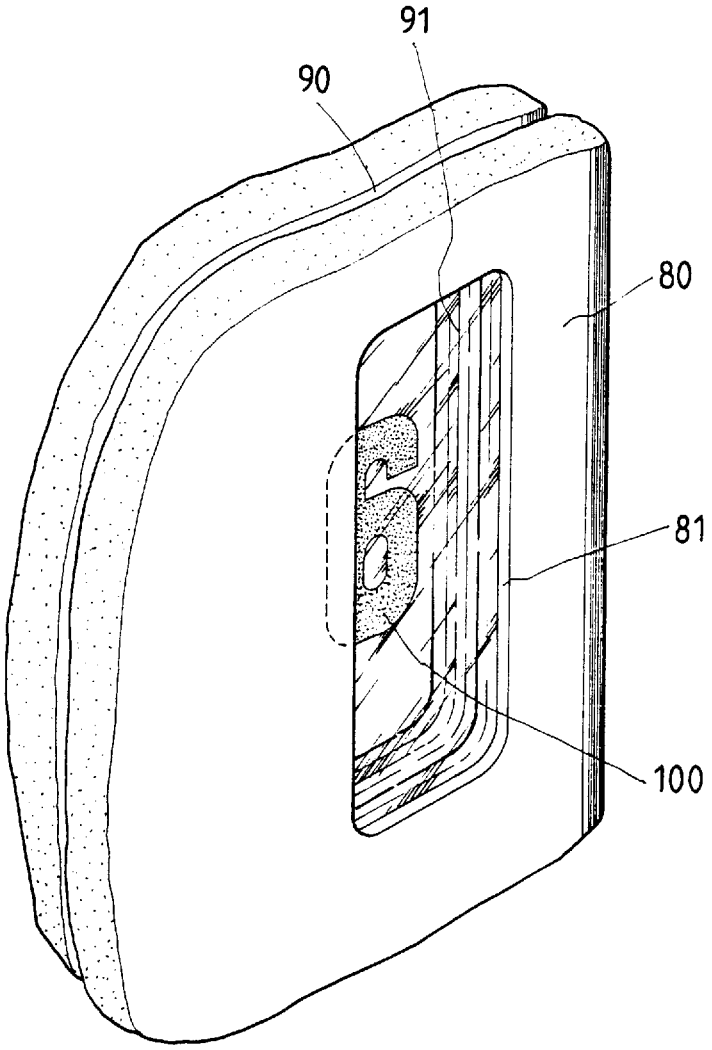
FIG, 12

AUXILIARY EMERGENCY ESCAPE DEVICE OF ELEVATOR

FIELD OF THE INVENTION

The present invention relates generally to an elevator, and more particularly to an auxiliary emergency escape device of the elevator.

BACKGROUND OF THE INVENTION

As shown in FIG. 1, a prior art elevator comprises an oil pressure mechanism 1 for actuating an oil pressure cylinder 2 to move up and clown. The oil pressure cylinder 2 is fastened at one end thereof with an elevator cab 3. The oil pressure mechanism 1 is provided with a decompression valve 4, which is intended for use by an elevator maintenance personnel to lower the elevator cab 3 in the event of a power outage, an elevator breakdown, or an elevator maintenance work. However, the elevator cab 3 may be caused by a power outage or accident to stop somewhere between two floors such that the door of the elevator cab 3 can not be opened, and that the passengers are trapped in the disabled cab.

SUMMARY OF THE INVENTION

The primary objective of the present invention is therefore to provide an elevator with an auxiliary emergency escape device, which comprises a manually-operated compression-decompression device located at the emergency window of the elevator cab. The compression-decompression device is fastened at one end thereof with an oil pipe which is in turn fastened at another end thereof with a compression valve. The compression valve is fastened at one end thereof with an oil pressure mechanism. In the event of an accident or power outage causing the elevator to incapacitate, the compression-decompression device is exerted on by the pressure of a preson's hand so as to actuate the compression valve or the decompression valve, thereby causing the oil pressure cylinder to move up or down. As a result, the elevator cab can be manually driven to a desired floor where the trapped passengers can escape.

BRIEF DESCRIPTION OF THE DRAWINGS

FIG. 1 shows a schematic view of the operating mechanism of a prior art elevator.

FIG. 2 shows a schematic view of the operating mechanism of an elevator of the present invention.

FIG. 5 shows a schematic view of a manually-operated compression device of another embodiment of the present invention.

FIG. 6 shows a partial schematic plan view of the compression device as shown in FIG. 5.

FIG. 7 shows a schematic view of an emergency window of the embodiment as shown in FIG. 5.

FIG. 8 shows a schematic view of the construction of still another embodiment of the present invention.

FIG. 9 shows a partial enlarged schematic view of the embodiment as shown in FIG. 8.

FIG. 10 shows a side view of the embodiment as shown in FIG. 8.

FIG. 11 shows a schematic view of the operation of the embodiment as shown in FIG. 10.

FIG. 12 shows a perspective view of a cab door of the elevator of the present invention.

DETAILED DESCRIPTION OF THE EMBODIMENTS

Figure 4:
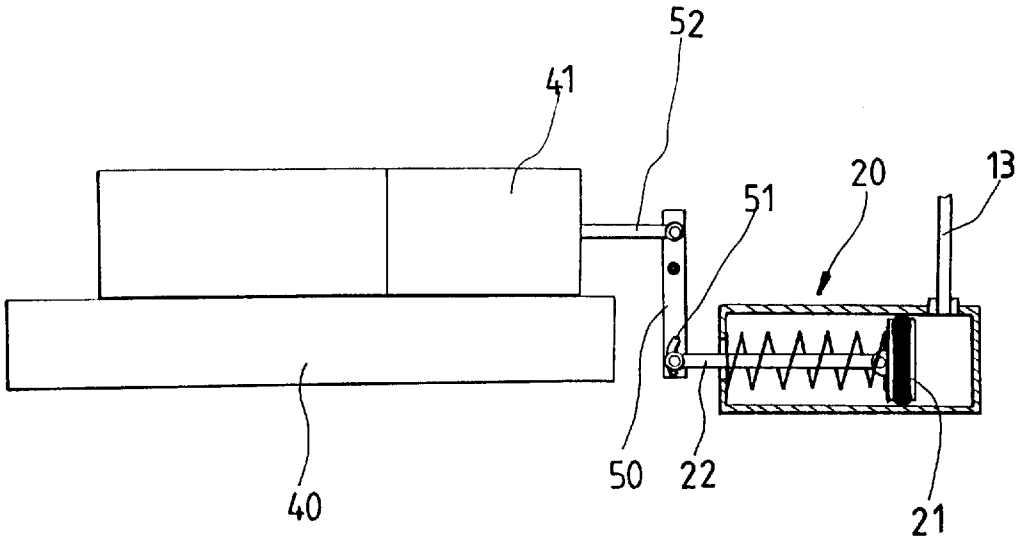
FIG. 4 shows a schematic view of a compression valve of the present invention.
Figure 3:
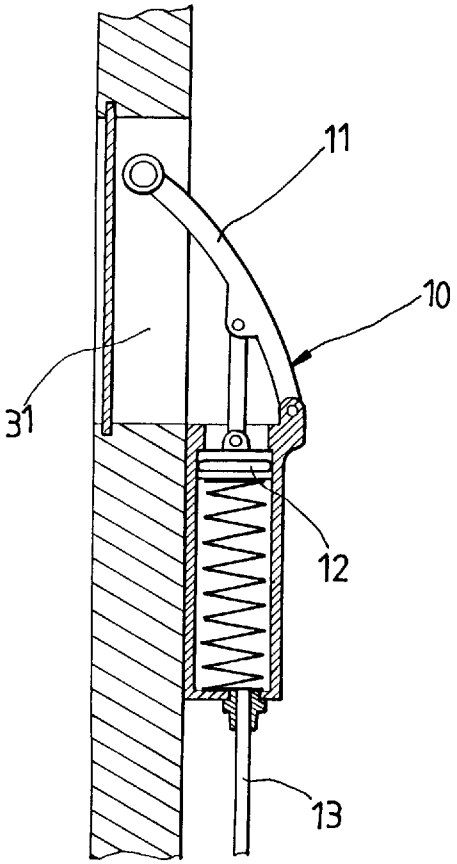
FIG. 3 shows an enlarged schematic view of a manually-operated compression device of the present invention.

As shown in FIGS. 2, 3 and 4, an elevator auxiliary emergency escape device embodied in the present invention is composed of a manually-operated compression apparatus 10 and a compression valve 20.

The manually-operated compression apparatus 10 is made up of a handle 11 and a piston 12. The compression apparatus 10 is fastened at one end thereof with an oil pipe 13 and is located at an emergency window 31 of an elevator cab 30 of the present invention.

The compression valve 20 is composed of a piston 21 and a push rod 22. The compression valve 20 is fastened at one end thereof with the oil pipe 13. The compression valve 20 is connected with an oil pressure mechanism 41 by a lever apparatus 50. The oil pressure mechanism 41 is located over an oil tank 40. The push rod 22 of the compression valve 20 is engaged with an arcuate hole 51 of the longer end of the lever apparatus 50. The oil pressure mechanism 41 is engaged with the short end of the lever apparatus 50 by means of a linking rod 52. The lever apparatus 50 is intended to provide a leverage to facilitate the efficient action of the compression valve 20 on the oil pressure mechanism 41. The length of the oil pipe 13 depends on the height of a building in which the elevator is located. The midpoint of the oil pipe 13 is corresponding in location to the midpoint of the building.

In the event that the elevator is disabled by a fire, power outage, or accident, a trapped passenger can reach for the handle 11 of the manually-operated compression device 10 from the emergency window 31 of the elevator cab 30. The piston 12 can be actuated by an external pressure exerting on the handle it by the hand of the trapped passenger such that the fluid contained in the oil pipe 13 is compressed by the piston 12 to act on the compression valve 20. As a result, the piston 21 of the compression valve 20 is at work such that the push rod 22 is actuated to cause the linking rod 52 of the lever apparatus 50 to act on the oil pressure mechanism 41, which in turn gives an added pressure to the oil pressure cylinder 42. The elevator cab 30 is thus lifted by the oil Pressure cylinder 42.

As shown in FIGS. 5, 6 and 7, a manually-operated compression device 60 of another embodiment of the present invention is located over the oil tank 40. A pulley set 61 is mounted over the oil tank 40 and is provided with a driving sector gear 611 and a driven sector gear 62 which is engaged with the driving sector gear 611 and is provided at one end thereof with two bearings 63 opposite to each other. One of the bearings 63 is fastened pivotally with the driven sector gear 62. The bearings 63 are provided therebetween with an eccentric shaft 64 with a push rod 65 being fastened pivotally therewith. The push rod 65 is fastened with the oil pressure mechanism 41. An action cable 66 is fastened at one end thereof with a revolving wheel 66 which is located at the top end of the elevator shaft. The action cable 66 is wound on the pulley set 61. The elevator cab 30 is provided with an emergency window 32 and a mask 33 fitted over the action cable 66.

In the event that the elevator is disabled by a fire, power outage or accident, a passenger trapped in the cab 30 can reach for the action cable 66 at the emergency window 32 of the cab 30 such that the action cable 66 is exerted on by the pressure of a hand of the trapped passenger, and that the pulley set 61 is rotated to force the driving sector gear 611 to actuate the driven sector gear 62. As the driven sector gear 62. As the driven sector gear 62 is driven, the eccentric shaft 64 is thus actuated to turn so as to force the push rod 65 to act on the oil pressure mechanism 41. As the oil pressure mechanism 41 is under pressure, the oil pressure cylinder 42 is acted on by the pressure which is increased gradually. As a result, the elevator cab 30 is lifted by the oil pressure cylinder 42 in in motion.

As shown in FIGS. 2 and 5, a decompression valve 70 can be actuated by an external force exerting on an action cable 14 by a passenger trapped in the disabled cab 30. As soon as the decompression valve 70 is activated by the pressure of a hand of the trapped Passenger, the fluid contained in the oil pressure cylinder 42 is so drained that the fluid flows back into the fluid storage tank. As a result of the decompression of the oil pressure cylinder 42, the elevator cab 30 is caused to descend gradually. In the meantime, the trapped passenger can observe through the see-through window 81 of the inner door 80 of the elevator cab 30, as illustrated in FIG. 12. As the see-through window 81 of the inner door 80 is exactly opposite to the see-through wind-down 91 of the outer door 90 of a given floor and the floor number "100" is flush with the outer door 90, the action cable 14 is released to interrupt the draining of the fluid of the oil pressure cylinder 42. In other words, as soon as the action cable 14 is let go by the trapped passenger, the elevator cab 30 in motion is stopped at once.

As shown in FIGS. 8, 9 10 and 11, one end of the action cable 14 in located securely at the bottom of the elevator shaft. The elevator cab 30 is provided therein with an action rod 16 which is engaged through the wall of the cab 30 with two balance wheels 17. The action cable 14 is put through between the two balance wheels 17. The balance wheels 17 can be actuated by the action rod 16 to engage in a planetary motion such that the action cable 14 is curved and that the decompression valve 70 is actuated to bring about the draining of the fluid of the oil pressure cylinder 42, thereby causing the elevator cab 30 to descend slowly. Located at the junction of the action cable 14 and the decompression valve 70 is a coil spring 18 for balancing the torsion of the action cable 14 and the balance wheels 17. The decompression valve 70 can not be accidentally activated as long as the action cable 14 is not exerted on by the force of the action rod 16 which is located inside the elevator cab 30 to safeguard the operator.

The embodiments of the present invention described above are to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An auxiliary escape device of a elevator, said escape device comprising:

a manually-operated compression or decompression apparatus located at an emergency window of an elevator cab such that said compression or decompression apparatus is in communication with a fluid pipe;

a compression or decompression valve fastened with said fluid pipe; and an oil pressure mechanism provided with a pressure cylinder and connected with said compression or decompression valve such that said oil pressure mechanism is activated by said compression or decompression valve at such time when said compression or decompression apparatus is exerted on by an external force, and that said pressure cylinder of said oil pressure mechanism is capable of lifting the elevator cab at such time when said pressure cylinder is compressed, and further that said pressure cylinder of said oil pressure mechanism is capable of causing the elevator cab to descend at such time when said pressure cylinder is decompressed.

2. The escape device as defined in claim 1, wherein said manually-operated compression or decompression apparatus is provided with an action cable fastened at one end thereof with a decompression valve of said pressure cylinder such that said action cable is located at anoter end thereof with a weight located at the bottom of the elevator shaft; and wherein elevator cab is provided with an emergency window through which a passenger trapped in the disabled elevator cab can activate said action cable so as t actuate said decompression valve to decompress said pressure cylinder, thereby causing the disabled elevator cab to descend.

3. The escape device as defined in claim 1, wherein said compression or decompression valve is provided with a piston.

4. The escape device as defined in claim 1, wherein said compression or decompression valve and said oil pressure mechanism are linked by a lever apparatus; wherein said compression or decompression valve is provided with a push rod which is fastened with one end of said lever apparatus; and wherein said oil pressure mechanism is provided with a linking rod which is fastened with another end of said lever apparatus.

5. The escape device as defined in claim 1, wherein the manually-operated compression or decompression apparatus is composed of a pulley set having a driving sector gear, a driven sector gear, two bearings, an eccentric shaft, an action cable, and a pulley, said eccentric shaft being fastened pivotally between said two bearings such that said eccentric shaft is provided with a push rod fastened pivotally therewith, said push rod being fastened at another end thereof with said oil pressure mechanism, said driven sector gear being fastened pivotally with one of said two bearings, said action cable being fastened at one end thereof with a rotary wheel located at the top of the elevator shaft.

6. The escape device as defined in claim 1, wherein said action cable has a free end which is located at the bottom of the elevator shaft; and wherein said elevator cab is provided therein with an action rod which is engaged throught a wall of the elevator cab with two balance wheels between which said action cable is put through, said action rod being capable of actuating said balance wheels to engage in a planetary motion for curving said action cable, thereby activating the decompression valve to drain said pressure cylinder so as to cause said elevator cab to descend.

7. The escape device as defined in claim 6, wherein said action cable and said decompression valve are provided therebetween with a coil spring for balancing the torsion of said action cable and said balance wheels.

8. The escape device as defined in claim 1, wherein said elevator cab is provided with an inner door and an outer door, said inner door and said outer door having a see-through window enabling a passenger trapped in the disabled elevator cab to see a floor number marked on the outer door.

* * * * *